US007040277B2

(12) United States Patent
Hasebe et al.

(10) Patent No.: US 7,040,277 B2
(45) Date of Patent: May 9, 2006

(54) CYLINDER OPERATION CONTROL APPARATUS FOR INTERNAL COMBUSTION ENGINE

(75) Inventors: Tetsuya Hasebe, Utsunomiya (JP); Shigetaka Kuroda, Utsunomiya (JP); Tetsu Sugiyama, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/530,657

(22) PCT Filed: Sep. 26, 2003

(86) PCT No.: PCT/JP03/12331

§ 371 (c)(1),
(2), (4) Date: Apr. 7, 2005

(87) PCT Pub. No.: WO2004/033862

PCT Pub. Date: Apr. 22, 2004

(65) Prior Publication Data

US 2005/0284438 A1 Dec. 29, 2005

(30) Foreign Application Priority Data

Oct. 11, 2002 (JP) ..... 2002-298595

(51) Int. Cl.
*F02B 77/00* (2006.01)

(52) U.S. Cl. ..... 123/198 F

(58) Field of Classification Search ..... 123/198 F
See application file for complete search history.

(56) References Cited

U.S. PATENT DOCUMENTS

| | | | |
|---|---|---|---|
| 6,092,497 | A | 7/2000 | Preston et al. |
| 6,382,173 | B1 | 5/2002 | Roe |
| 6,557,518 | B1 | 5/2003 | Albertson et al. |

FOREIGN PATENT DOCUMENTS

| | | |
|---|---|---|
| EP | 2002-242717 | 8/2002 |
| EP | 2002-242718 | 8/2002 |
| JP | 7-63097 | 3/1995 |

*Primary Examiner*—Noah P. Kamen
(74) *Attorney, Agent, or Firm*—Arent Fox PLLC

(57) ABSTRACT

A cylinder operation control apparatus includes: an internal combustion engine (E) which is adapted to operate in an all-cylinder activation mode and in a cylinder deactivation mode; a lift amount changing device (VT) which is associated with the internal combustion engine (E), and which enables switching between the all-cylinder activation mode and the cylinder deactivation mode by changing the amount of lifts of intake and exhaust valves (IV, EV) associated with the cylinders; a lift operating device (33) which is associated with the lift amount changing device (VT) to operate the same; a cylinder activation enforcing device (33') which is operatively disposed between the lift amount changing device (VT) and the lift operating device (33) so as to enforce the all-cylinder activation mode as necessary.

7 Claims, 8 Drawing Sheets

CYLINDER OPERATION CONTROL APPARATUS FOR INTERNAL COMBUSTION ENGINE

CROSS-REFERENCE TO RELATED APPLICATION

This application is a National Stage entry of International Application Number PCT/JP03/12331, filed Sep. 26, 2003. The disclosure of the prior application is hereby incorporated herein in its entirety by reference.

BACKGROUND OF THE INVENTION

1. Field of the Invention

The present invention relates to a cylinder operation control apparatus for an internal combustion engine, which enables a switching operation between an all-cylinder activation mode in which all cylinders of the engine are activated, and a cylinder deactivation mode in which at least a cylinder of the engine is deactivated.

2. Description of the Related Art

Among hybrid vehicles, a type of hybrid vehicle is known in which a cylinder deactivation operation is executed, for example, by controlling valve trains of the engine using hydraulic control method in order to further improve fuel economy by means of reduction in friction of the engine. In this type of hybrid vehicle, when the vehicle enters a deceleration state, a cylinder deactivation operation is executed along with a fuel cut operation so as to decrease engine friction, and as a result, the amount of regenerated electric energy is increased by an amount corresponding to the decreased engine friction, and thus fuel economy is improved (see, for example, Japanese Unexamined Patent Application, First Publication No. Hei 07-63097).

Accordingly, if an engine is employed, in which an all-cylinder deactivation operation is made possible, energy, which would have been dissipated due to engine friction during a deceleration operation, can be maximally recovered, and thus a hybrid vehicle having excellent fuel economy can be obtained.

As described above, fuel economy can be greatly improved by employing an all-cylinder deactivation operation; however, in general, some of the cylinders must remain as normally activated cylinders so as to be able to drive the vehicle upon resuming fuel supply to the activated cylinders just in case the cylinder deactivation mechanism fails. Accordingly, friction due to the normally activated cylinders remain unchanged during a deceleration operation; therefore, fuel economy is not greatly improved.

SUMMARY OF THE INVENTION

In view of the above circumstances, an object of the present invention is to provide a cylinder operation control apparatus for an internal combustion engine, which enables maximal improvement in fuel economy due to a cylinder deactivation operation, while also enabling drive of the vehicle even when a valve lift operating device in a cylinder deactivation mechanism fails.

In order to achieve the above object, the present invention provides a cylinder operation control apparatus including: an internal combustion engine which is adapted to operate in an all-cylinder activation mode in which all-cylinders thereof are activated, and in a cylinder deactivation mode in which at least a cylinder thereof is deactivated; a lift amount changing device which is associated with the internal combustion engine, and which enables switching between the all-cylinder activation mode and the cylinder deactivation mode by changing the amount of lifts of intake and exhaust valves associated with the cylinders; a lift operating device which is associated with the lift amount changing device to operate the same; a cylinder activation enforcing device which is operatively disposed between the lift amount changing device and the lift operating device so as to enforce the all-cylinder activation mode as necessary; and a control unit which is operatively connected to the lift amount changing device, the lift operating device, and the cylinder activation enforcing device, for controlling the operation mode of the internal combustion engine.

According to the above cylinder operation control apparatus of the present invention, the internal combustion engine can be placed in the all-cylinder activation mode or in the cylinder deactivation mode by operating the lift amount changing device using the lift operating device so as to control the amount of lifts of the intake and exhaust valves. In addition, the internal combustion engine can be enforcedly returned to the all-cylinder activation mode from the cylinder deactivation mode by operating the cylinder activation enforcing device; therefore, the internal combustion engine can be reliably returned to the all-cylinder activation mode from a state in which all of the cylinders are deactivated.

In the above cylinder operation control apparatus, the lift amount changing device may include a hydraulic variable valve timing mechanism. The control unit may be adapted to control the oil pressure for the hydraulic variable valve timing mechanism so as to suspend the operations of the intake and exhaust valves when the internal combustion engine is placed in the cylinder deactivation mode. The control unit may be adapted to operate the cylinder activation enforcing device so as to enforce normal operations of the intake and exhaust valves as necessary.

According to the above cylinder operation control apparatus of the present invention, by suspending the operations of the intake and exhaust valves using the hydraulic variable valve timing mechanism, the engine friction can be further reduced, and fuel economy can also be further improved.

The present invention also provides a cylinder operation control apparatus including: an internal combustion engine which is adapted to operate in an all-cylinder activation mode in which all-cylinders thereof are activated, and in a cylinder deactivation mode in which at least a cylinder thereof is deactivated; a lift amount changing device which is associated with the internal combustion engine, and which is adapted to change the amount of lifts of intake and exhaust valves associated with the cylinders using an operation oil supplied from a hydraulic power source; a cylinder activation passage connected to the lift amount changing device for placing the internal combustion engine in the all-cylinder activation mode; a cylinder deactivation passage connected to the lift amount changing device for placing the internal combustion engine in the cylinder deactivation mode; an oil supply passage which is connected to the cylinder activation passage and the cylinder deactivation passage for supplying the operation oil to the lift amount changing device, and which is provided with an oil supply branching passage branching therefrom; a drain passage which is connected to the cylinder activation passage and the cylinder deactivation passage for allowing the operation oil to return to the hydraulic power source, and which is provided with a drain branching passage branching therefrom; a switching device which is connected to the cylinder activation passage, the cylinder deactivation passage, the oil supply passage, and the drain passage, for optionally supplying the operation oil from the hydraulic power source to the cylinder activation passage or to the cylinder deactivation passage; and a cylinder activation enforcing device which is connected to the cylinder activation passage, the cylinder deactivation passage, the oil supply branching passage, and the drain branching passage, for enforcing the all-cylinder activation mode.

In the above cylinder operation control apparatus, the cylinder activation enforcing device may include: a cylinder activation port for optionally connecting the oil supply branching passage to the cylinder activation passage or disconnecting the oil supply branching passage from the cylinder activation passage; and a cylinder deactivation port for optionally connecting the drain branching passage to the cylinder deactivation passage or disconnecting the drain branching passage from the cylinder deactivation passage.

According to the above cylinder operation control apparatus of the present invention, the operation mode of the internal combustion engine can be switched between the all-cylinder activation mode and the cylinder deactivation mode by optionally supplying the operation oil from the hydraulic power source to the cylinder activation passage or to the cylinder deactivation passage using the switching device. Moreover, the operation oil can be supplied to the cylinder activation passage so as to place the engine in the all-cylinder activation mode by connecting the oil supply branching passage to the cylinder activation passage using the cylinder activation port of the cylinder activation enforcing device and by connecting the drain branching passage to the cylinder deactivation passage using the cylinder deactivation port even when the engine is supposed to be placed in the cylinder deactivation mode in which the operation oil is supplied to the cylinder deactivation passage by the operation of the switching device. Therefore, the internal combustion engine can be reliably returned to the all-cylinder activation mode from a state in which all of the cylinders are deactivated.

In the above cylinder operation control apparatus, the cylinder activation enforcing device may include a spool valve having a spool therein. The spool valve may be adapted to perform the connecting and disconnecting operations between the oil supply branching passage and the cylinder activation passage, and connecting and disconnecting operations between the drain branching passage and the cylinder deactivation passage, by sliding the spool to respective predetermined positions.

According to the above cylinder operation control apparatus of the present invention, the connection or disconnection between the supply branching passage and the cylinder activation passage, and the connection or disconnection between the drain branching passage and the cylinder deactivation passage can be performed by the cylinder activation port and the cylinder deactivation port, i.e., the connection or disconnection between the supply branching passage and the cylinder activation passage, and the connection or disconnection between the drain branching passage and the cylinder deactivation passage can be executed by just a single operation of the spool; therefore, a preferable efficiency in operation can be obtained.

BRIEF DESCRIPTION OF THE DRAWINGS

FIG. 3A shows a cross-section of the main part of the variable valve timing mechanism in an all-cylinder activation mode, and FIG. 3B shows a cross-section of the main part of the variable valve timing mechanism in an all-cylinder deactivation mode.

DESCRIPTION OF THE PREFERRED EMBODIMENTS

The preferred embodiments of the present invention will be explained below with reference to the appended drawings.

The construction of a parallel hybrid vehicle, which includes a hydraulic pressure supplying device for valve trains according to a first embodiment of the present invention, will be explained below with reference to FIG. 1.

Figure 1:
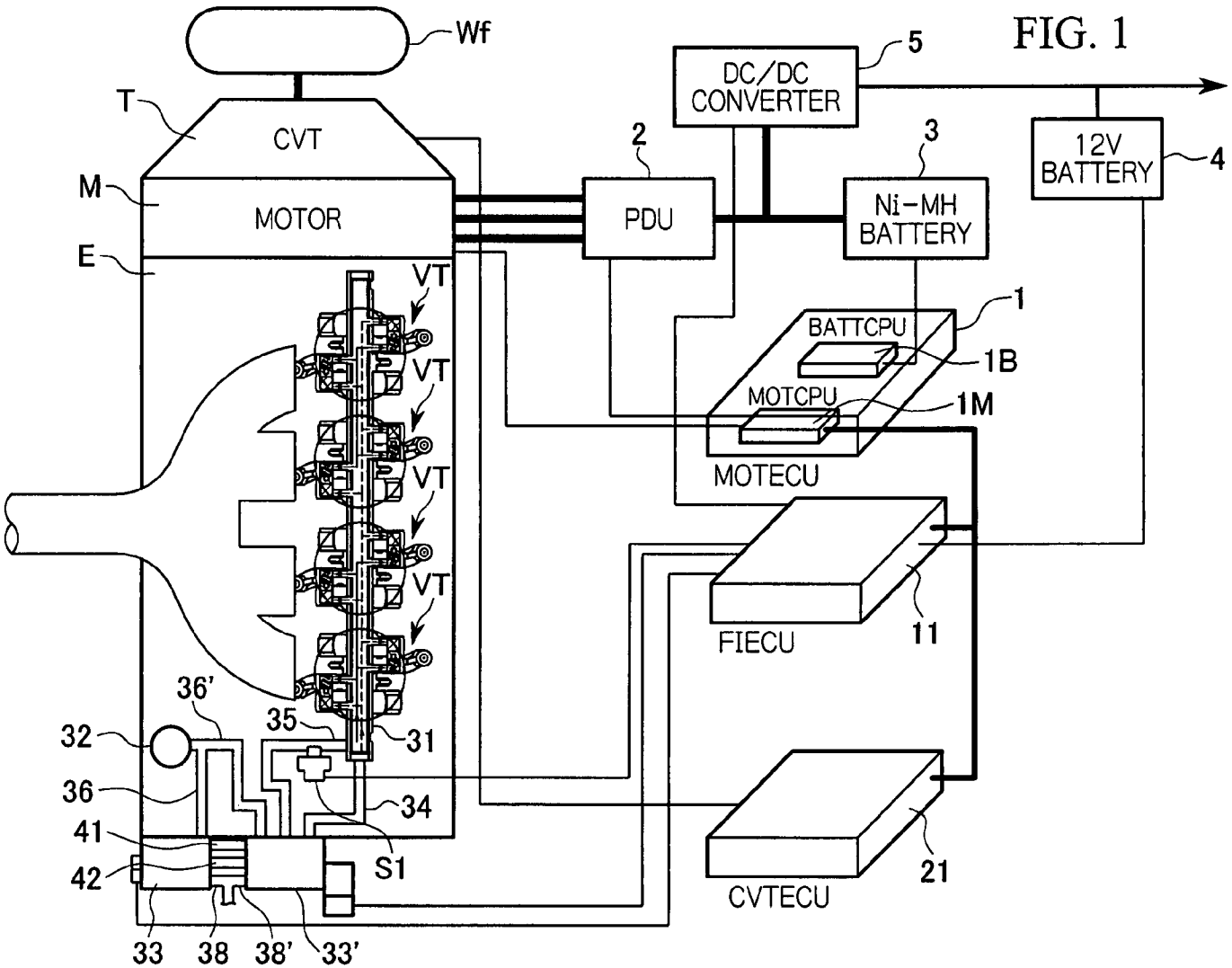
FIG. 1 is a block diagram showing the general structure of a hybrid vehicle in a first embodiment according to the present invention.

As shown in FIG. 1, the hybrid vehicle includes an engine E, a motor M, and a transmission T, which are coupled to each other in series. The driving power generated by at least one of the engine E and the motor M is transmitted via, for example, a CVT (continuously variable transmission) as the transmission T (the transmission T may be a manual transmission) to front wheels Wf as driving wheels. When the driving power is transmitted from the driving wheels Wf to the motor M during deceleration of the hybrid vehicle, the motor M acts as a generator for applying a so-called regenerative braking force to the vehicle, i.e., the kinetic energy of the vehicle is recovered and stored as electrical energy.

The driving of the motor M and the regenerating operation of the motor M are controlled by a power drive unit (PDU) 2 according to control commands from a motor CPU 1M of a motor ECU 1. A high-voltage nickel metal hydride battery 3 for sending electrical energy to and receiving electrical energy from the motor M is connected to the power drive unit 2. The battery 3 includes a plurality of modules connected in series, and in each module, a plurality of cell units are connected in series. The hybrid vehicle includes a 12-volt auxiliary battery 4 for energizing various electrical accessories. The auxiliary battery 4 is connected to the battery 3 via a downverter 5 as a DC-DC converter. The downverter 5, which is controlled by an FIECU 11, makes the voltage from the battery 3 step-down and charges the auxiliary battery 4. Note that the motor ECU 1 includes a battery CPU 1B for protecting the battery 3 and calculating the state of charge of the battery 3. In addition, a CVTECU 21 is connected to the transmission T, which is a CVT, for controlling the same.

The FIECU 11 controls, in addition to the motor ECU 1 and the downverter 5, a fuel injection valve (not shown) for controlling the amount of fuel supplied to the engine E, a starter motor, ignition timing, etc. To this end, the FIECU 11 receives various signals such as a signal from a vehicle speed sensor, a signal from an engine revolution rate sensor, a signal from a shift position sensor, a signal from a brake switch, a signal from a clutch switch, a signal from a throttle opening-degree sensor, and a signal from an intake negative pressure sensor. In addition, the FIECU 11 also receives a signal from POIL sensor (oil pressure measuring device) S1, and signals from the solenoids of spool valves 33 and 33', which will be further explained later.

Next, the variable valve timing mechanism VT and hydraulic control devices therefor will be explained in detail with reference to FIGS. 2 to 4.

Figure 2:
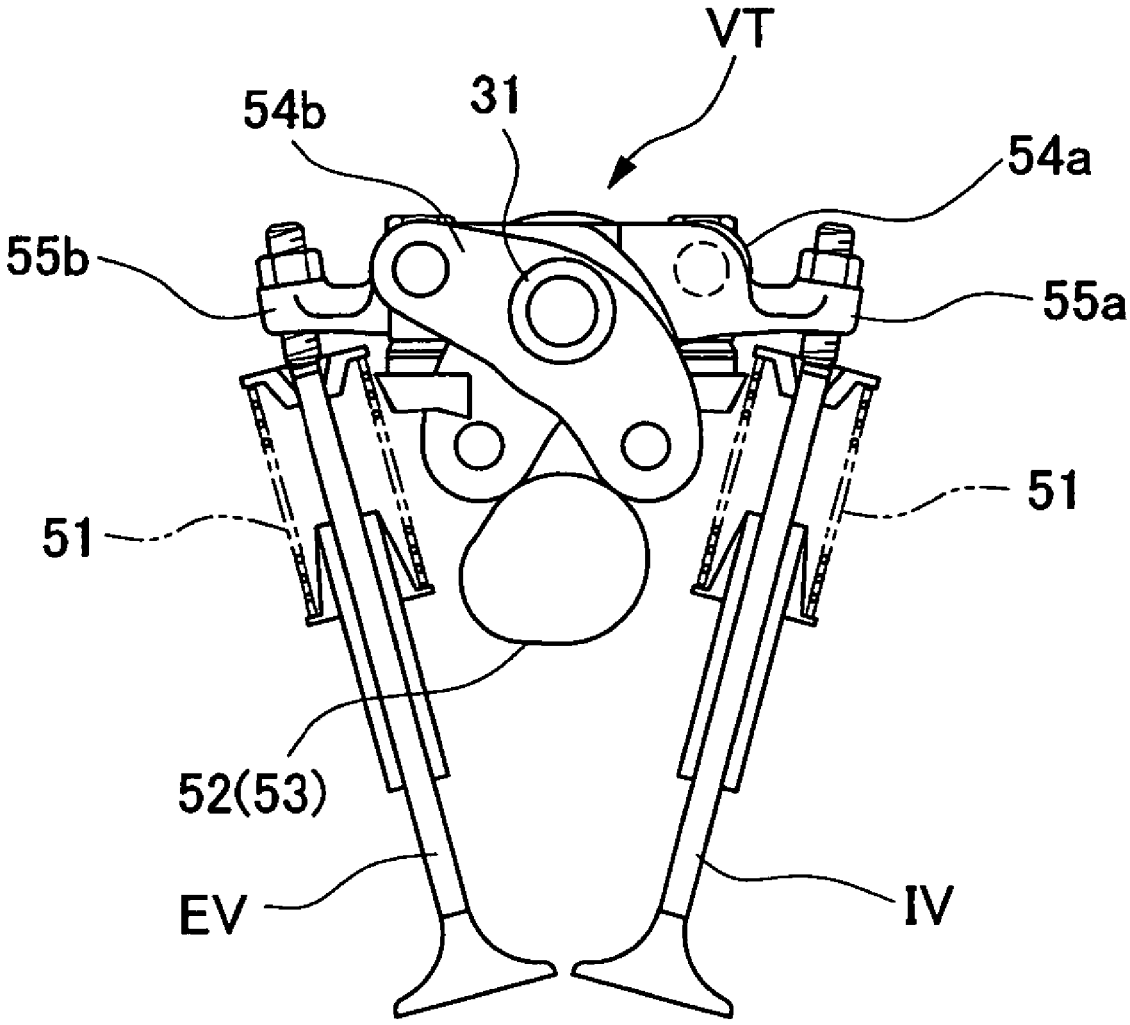
FIG. 2 is a front view showing a variable valve timing mechanism used in the first embodiment of the present invention.

As shown in FIG. 2, the cylinder (not shown) is provided with an intake valve IV and an exhaust valve EV which are biased by valve springs 51 and 51 in a direction which closes an intake port (not shown) and an exhaust port (not shown), respectively. Reference symbol 52 indicates a lift cam provided on a camshaft 53. The lift cam 52 is engaged with an intake cam lifting rocker arm 54*a* for lifting the intake valve and an exhaust cam lifting rocker arm 54*b* for lifting the exhaust valve, both of which are rockably supported by the rocker shaft 31.

Figure 3B:
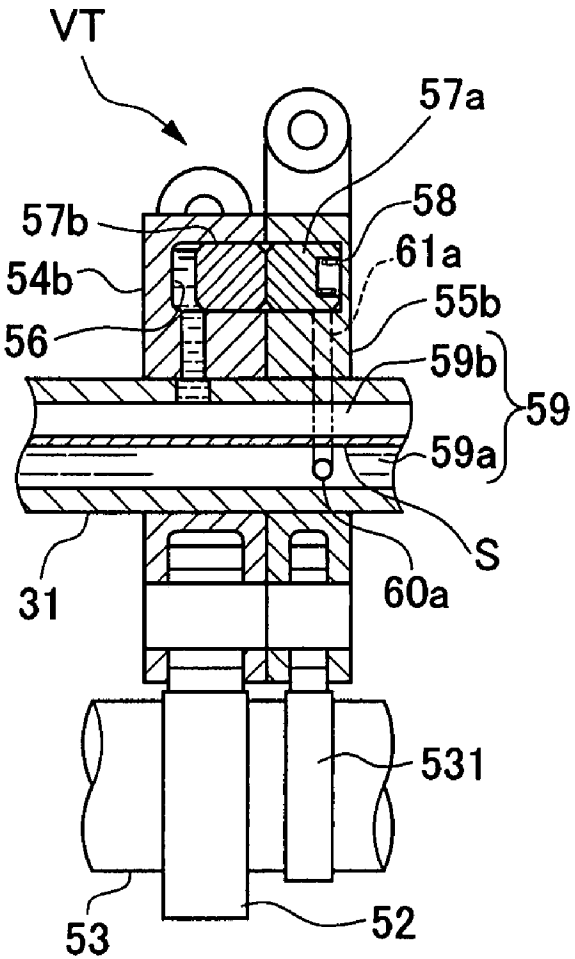
FIGS. 3A and 3B show the variable valve timing mechanism used in the first embodiment of the present invention; in particular.
Figure 3A:
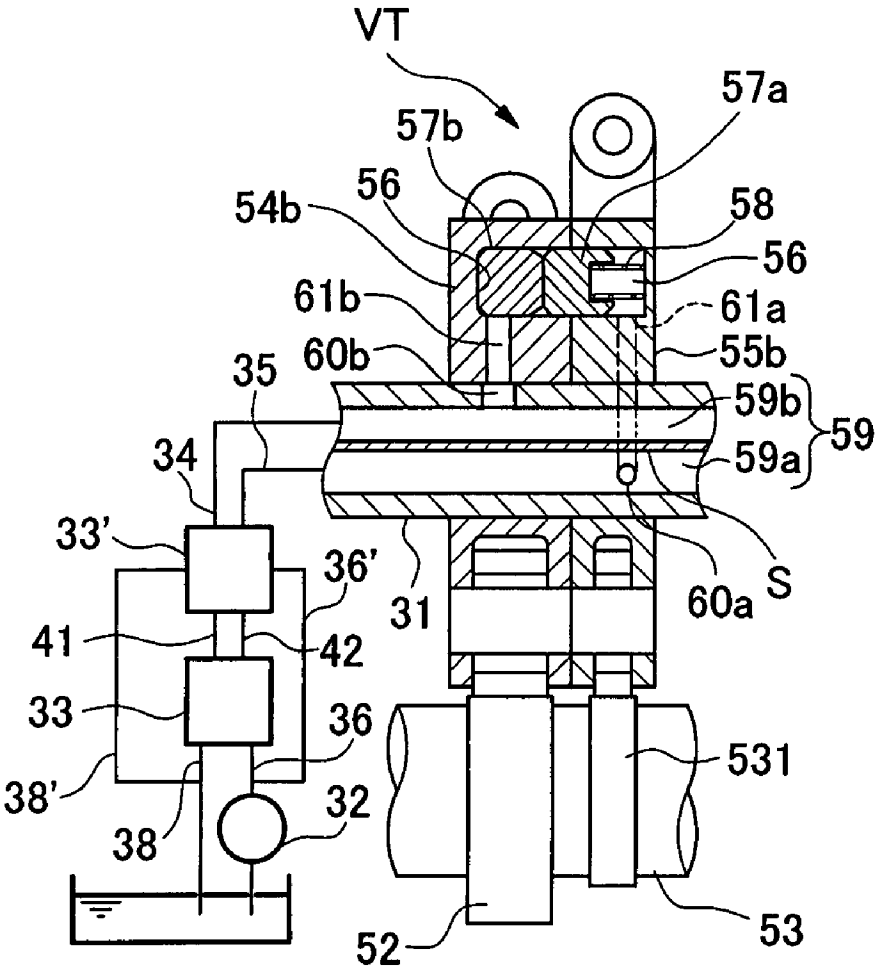

The rocker shaft 31 also supports valve operating rocker arms 55*a* and 55*b* in a rockable manner, which are located adjacent to the cam lifting rocker arms 54*a* and 54*b*, and whose rocking ends press the top ends of the intake valve IV and the exhaust valve EV, respectively, so that the intake valve IV and the exhaust valve EV open their respective ports. As shown in FIGS. 3A and 3B, the proximal ends (opposite the ends contacting the valves) of the valve operating rocker arms 55*a* and 55*b* are adapted to engage a circular cam 531 provided on the camshaft 53.

FIGS. 3A and 3B show, as an example, the cam lifting rocker arm 54*b* and the valve operating rocker arm 55*b* associated with the exhaust valve EV.

As shown in FIGS. 3A and 3B, a hydraulic chamber 56 is formed in the cam lifting rocker arm 54*b* and the valve operating rocker arm 55*b* in a continuous manner, which is located on the opposite side of the rocker shaft 31 with respect to the lift cam 52. The hydraulic chamber 56 is provided with a pin 57*a* and a disengaging pin 57*b*, both of which are made slidable and are biased toward the cam lifting rocker arm 54*b* by means of a pin spring 58.

The rocker shaft 31 is provided therein a hydraulic passage 59 which is divided into hydraulic passages 59*a* and 59*b* by a partition S. The hydraulic passage 59*b* is connected to the hydraulic chamber 56 at the position where the disengaging pin 57*b* is located via an opening 60*b* of the hydraulic passage 59*b* and a communication port 61*b* in the cam lifting rocker arm 54*b*. The hydraulic passage 59*a* is connected to the hydraulic chamber 56 at the position where the pin 57*a* is located via an opening 60*a* of the hydraulic passage 59*a* and a communication port 61*a* in the valve operating rocker arm 55*b*, and is adapted to be further connectable to a drain passage 38.

As shown in FIG. 3A, the pin 57*a* is positioned by the pin spring 58 so as to bridge the cam lifting rocker arm 54*b* and the valve operating rocker arm 55*b* when oil pressure is not applied via the hydraulic passage 59*b*. On the other hand, when oil pressure is applied via the hydraulic passage 59*b* in accordance with a cylinder deactivation signal, both of the pin 57*a* and the disengaging pin 57*b* slide toward the valve operating rocker arm 55*b* against the biasing force of the pin spring 58, and the interface between the pin 57*a* and the disengaging pin 57*b* corresponds to the interface between the cam lifting rocker arm 54*b* and the valve operating rocker arm 55*b* so as to disconnect these rocker arms 54*b* and 55*b*, as shown in FIG. 3B. The intake valve side is constructed in a similar manner. The hydraulic passages 59*a* and 59*b* are connected to an oil pump 32 via the spool valves 33 and 33' which are provided for ensuring oil pressure of the variable valve timing mechanisms VT.

Figure 4:
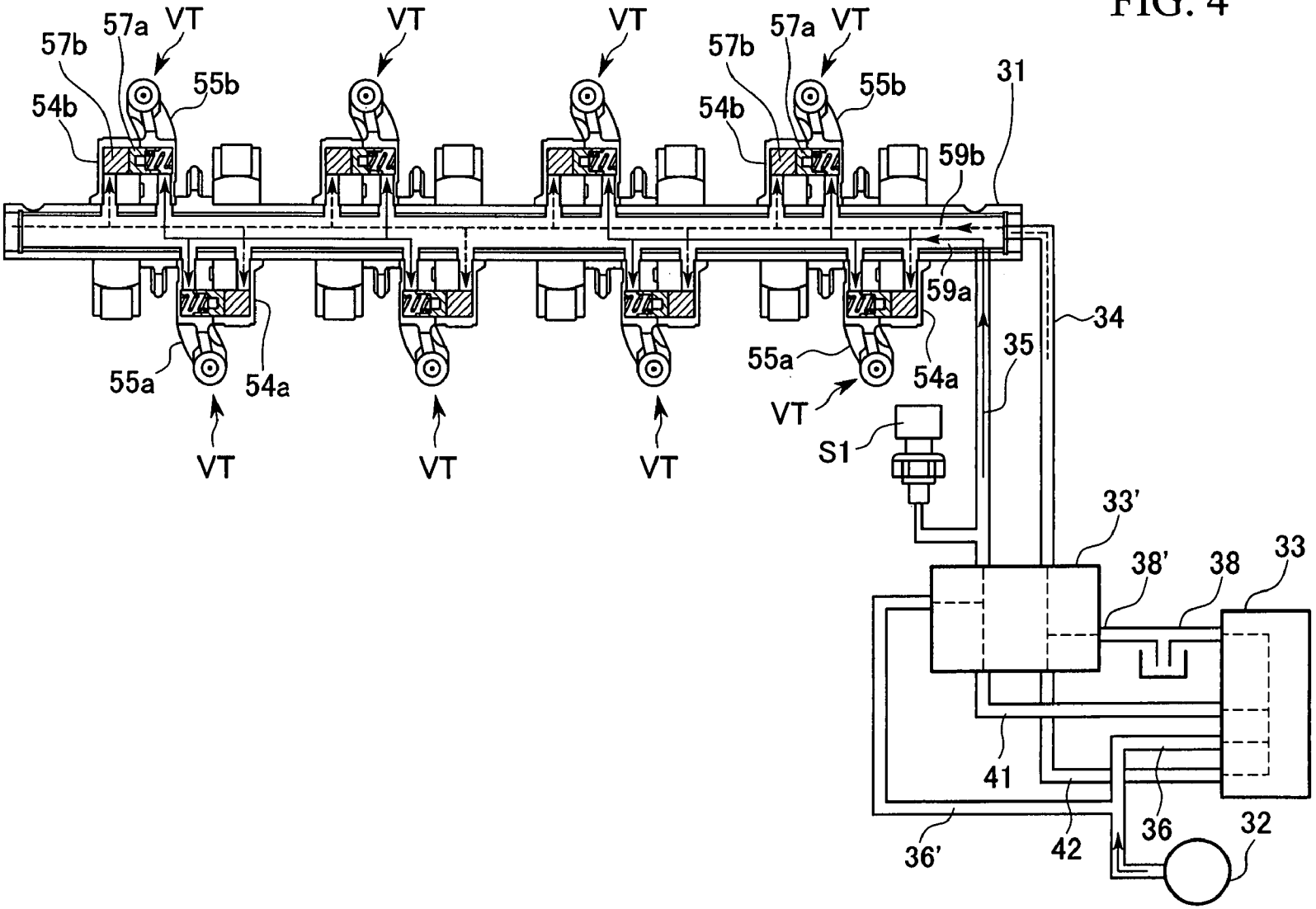
FIG. 4 is an enlarged view of the main part in FIG. 1.

As shown in FIG. 4, a cylinder deactivation passage 34 is connected to the hydraulic passage 59*b* in the rocker shaft 31, and a cylinder activation passage 35 is connected to the hydraulic passage 59*a*.

The spool valve 33', which is provided as a cylinder activation enforcing device, is disposed between the spool valve 33, which is provided as a lift amount changing device, and the variable valve timing mechanisms VT, which are provided as a lift operating device. A continuous cylinder activation, which will be explained below in detail, is executed by operating the spool valve 33'.

Figure 5:
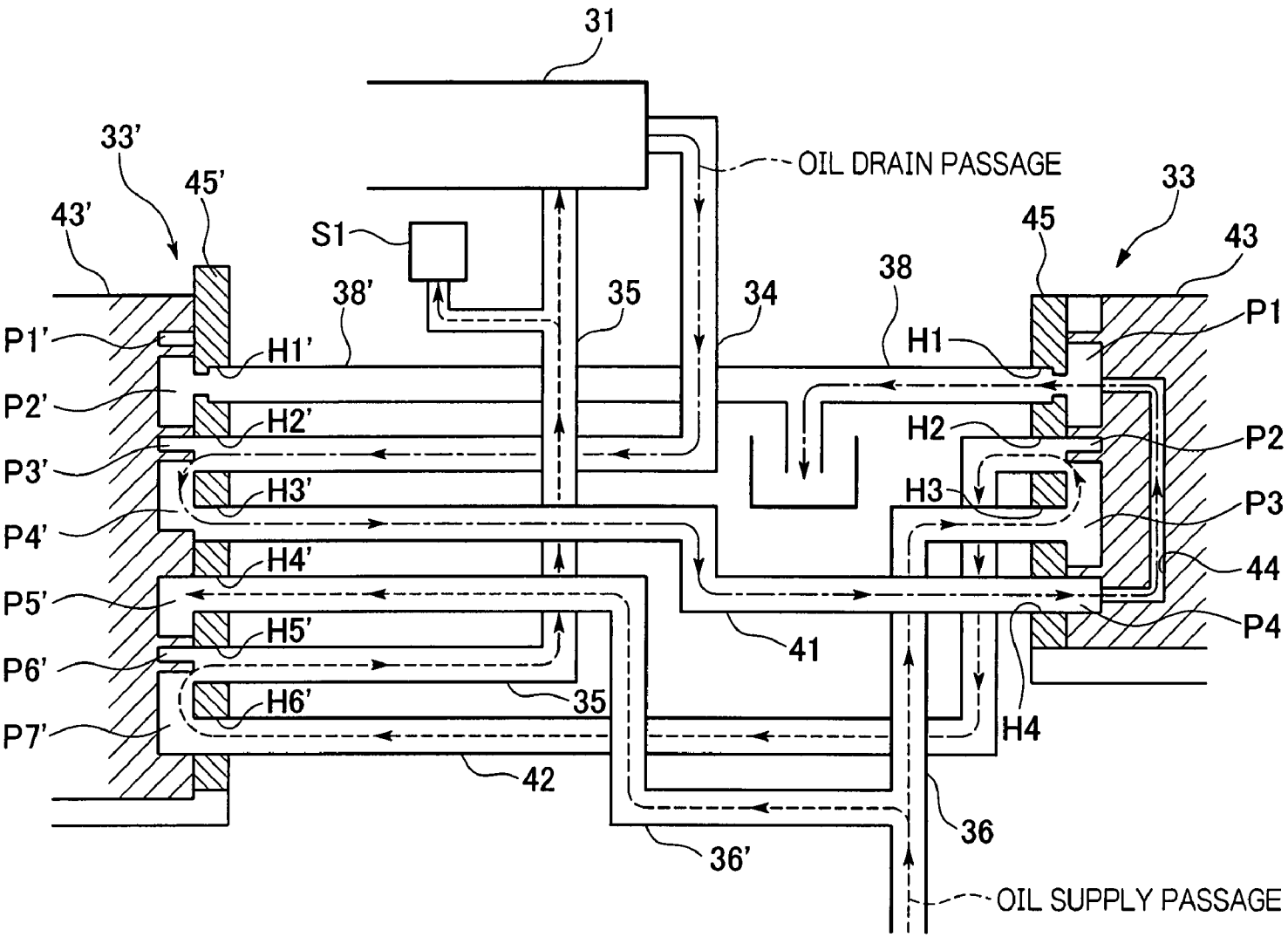
FIG. 5 is a diagram showing the flow of an operation oil in the all-cylinder activation mode.

As shown in FIG. 5, the spool valve 33 includes a casing 45 in which connection ports H1 to H4 are formed, and a spool 43 disposed inside the casing 45. In the surface of the spool 43 that faces the inner surface of the casing 45 in which connection ports H1 to H4 are formed, there are formed recesses, and the recesses and the inner surface of the casing 45 delimit ports P1 to P4. Among the ports P1 to P4, the ports P1 and P4 are connected to each other via a communication passage 44. The spool 43 is made slidable along the inner surface of the casing 45 in which connection ports H1 to H4 are formed using a solenoid (not shown).

Moreover, similarly to the spool valve 33, the spool valve 33' includes a casing 45' in which connection ports H1' to H6' are formed, and a spool 43' disposed inside the casing 45'. Recesses, which are formed in the spool 43', and the inner surface of the casing 45' of the spool 43' delimit ports P1' to P7'. The spool 43' is made slidable along the inner surface of the casing 45' using a solenoid (not shown).

The connection ports H1 to H4 of the spool valve 33 and the connection ports H1' to H6' of the spool valve 33' are connected to oil passages in which the operation oil flows, respectively. More specifically, the connection ports H1 to H4 are connected to a drain passage 38, a cylinder activation connection passage 42, an oil supply passage 36, and a cylinder deactivation connection passage 41, respectively. The connection ports H1' to H6' are connected to a drain branching passage 38' (a branching passage 38'), the cylinder deactivation passage 34, the cylinder deactivation connection passage 41, an oil supply branching passage 36' (a branching passage 36'), the cylinder activation passage 35, the cylinder activation connection passage 42, respectively.

When the spool 43 of the spool valve 33 and the spool 43' of the spool valve 33' are slid, the above-mentioned passages are connected to each other and disconnected from each other by means of the ports P1 to P4 formed in the spool 43 and the ports P1' to P7' formed in the spool 43'. Such operations will be further explained below with reference to FIGS. 5 to 7.

FIG. 5 is a diagram showing the flow of the operation oil in the all-cylinder activation mode. As shown in FIG. 5, the spool valve 33 is controlled so that the drain passage 38 and the cylinder deactivation connection passage 41 are connected to each other via the ports P1 and P4, and the oil supply passage 36 and the cylinder activation connection passage 42 are connected to each other via the ports P2 and P3. On the other hand, the spool valve 33' is controlled so that the cylinder deactivation passage 34 and the cylinder deactivation connection passage 41 are connected to each other via the port P4', the cylinder activation connection passage 42 and the cylinder activation passage 35 are connected to each other via the port P7', and the branching passages 38' and 36' are closed by the ports P2' and P5'.

In this state, the operation oil supplied from the oil pump 32 (see FIG. 4) flows into the connection port H3 of the spool valve 33 via the oil supply passage 36, and then flows into the cylinder activation connection passage 42 via the port P3 and the connection port H2. The operation oil which flowed into the cylinder activation connection passage 42 flows into the connection port H6' in the spool valve 33', and flows into the cylinder activation passage 35 via the port P7' and the connection port H5', and thus the operation oil is supplied into the oil passage 59*a* in the rocker shaft 31. The branching passage 36' branching from the oil supply passage 36 is closed by the port P5'.

On the other hand, the operation oil that has been held in the oil passage 59*b* in the rocker shaft 31 flows into the connection port H2' in the spool valve 33' via the cylinder deactivation passage 34, and then flows into the cylinder deactivation connection passage 41 via the port P4' and the connection port H3'. The operation oil which flowed into the cylinder deactivation connection passage 41 flows into the connection port H4 in the spool valve 33, and then flows into the drain passage 38 via the port P4, the communication passage 44, the port P1, and the connection port H1. The branching passage 38' branching from the drain passage 38 is closed by the port P2'.

As explained above, the operation oil is supplied into the hydraulic passage 59*a* for the all-cylinder activation operation provided in the rocker shaft 31, and the operation oil that has been held in the hydraulic passage 59*b* for the all-cylinder deactivation operation is released, and thus the all-cylinder activation operation is executed.

Figure 6:
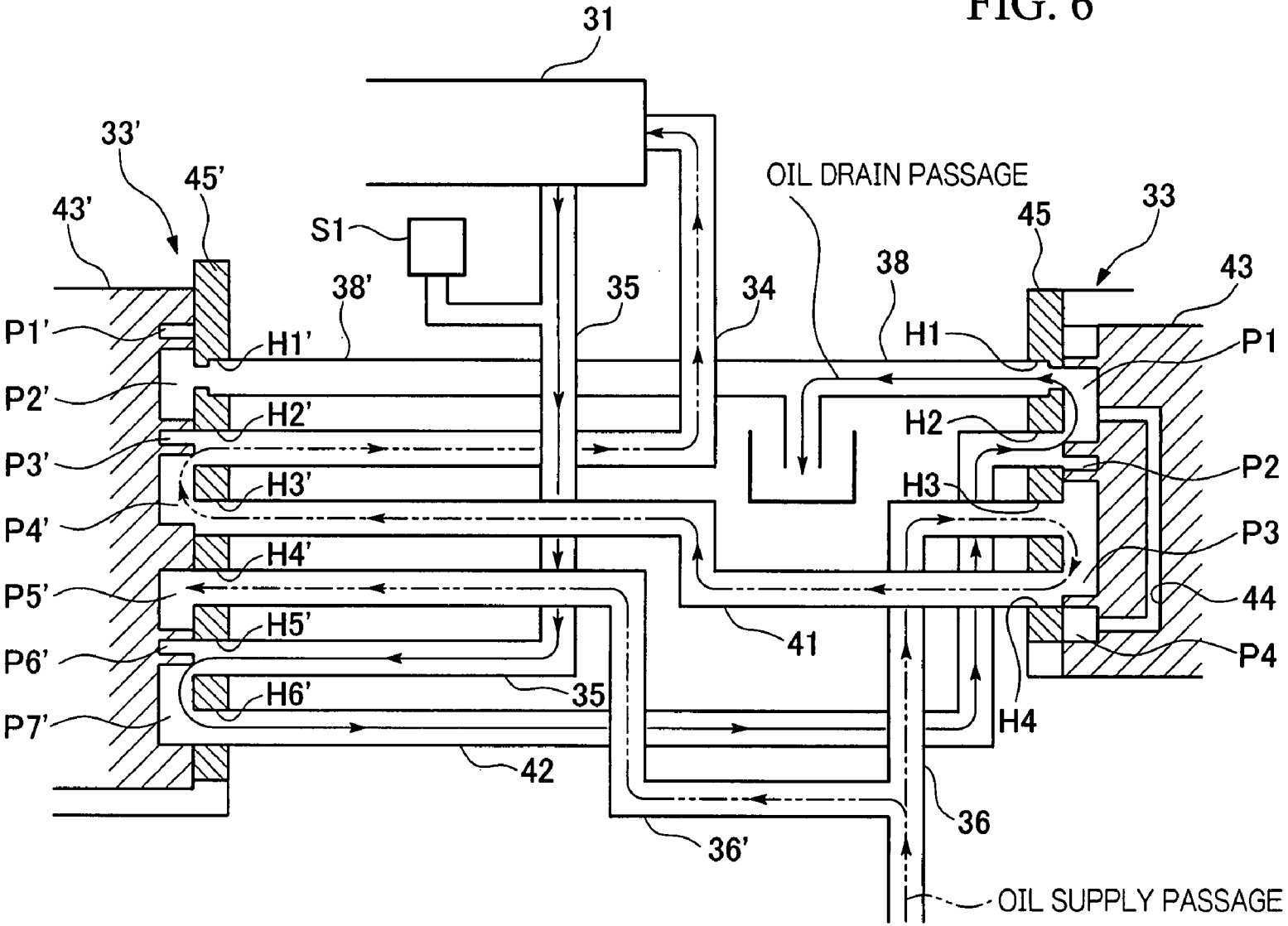
FIG. 6 is a diagram showing the flow of the operation oil in the all-cylinder deactivation mode.

FIG. 6 is a diagram showing the flow of the operation oil in the all-cylinder deactivation mode. As shown in FIG. 6, the spool 43 of the spool valve 33 is moved downward when compared with the state shown in FIG. 5. As shown in FIG. 6, the spool valve 33 is controlled so that the drain passage 38 and the cylinder activation connection passage 42 are connected to each other via the ports P1 and P2, and the oil supply passage 36 and the cylinder deactivation connection passage 41 are connected to each other via the port P3.

On the other hand, the spool 43' of the spool valve 33' is held in the same position as in the state shown in FIG. 5.

In this state, the operation oil supplied from the oil pump 32 (see FIG. 4) flows into the connection port H3 of the spool valve 33 via the oil supply passage 36, and then flows into the cylinder deactivation connection passage 41 via the port P3 and the connection port H4. The operation oil which flowed into the cylinder deactivation connection passage 41 flows into the connection port H3' in the spool valve 33', and flows into the cylinder deactivation passage 34 via the port P4' and the connection port H2', and thus the operation oil is supplied into the oil passage 59*b* in the rocker shaft 31. The branching passage 36' branching from the oil supply passage 36 is closed by the port P5' as in the state shown in FIG. 5.

On the other hand, the operation oil that has been held in the oil passage 59*a* in the rocker shaft 31 flows into the connection port H5' in the spool valve 33' via the cylinder activation passage 35, and then flows into the cylinder activation connection passage 42 via the port P7' and the connection port H6'. The operation oil which flowed into the cylinder activation connection passage 42 flows into the connection port H2 in the spool valve 33, and then flows into the drain passage 38 via the port P1 and the connection port H1. The branching passage 38' branching from the drain passage 38 is closed by the port P2'.

As explained above, the operation oil is supplied into the hydraulic passage 59*b* for the all-cylinder deactivation operation provided in the rocker shaft 31, and the operation oil that has been held in the hydraulic passage 59*a* for the all-cylinder activation operation is released, and thus the all-cylinder deactivation operation is executed.

Figure 7:
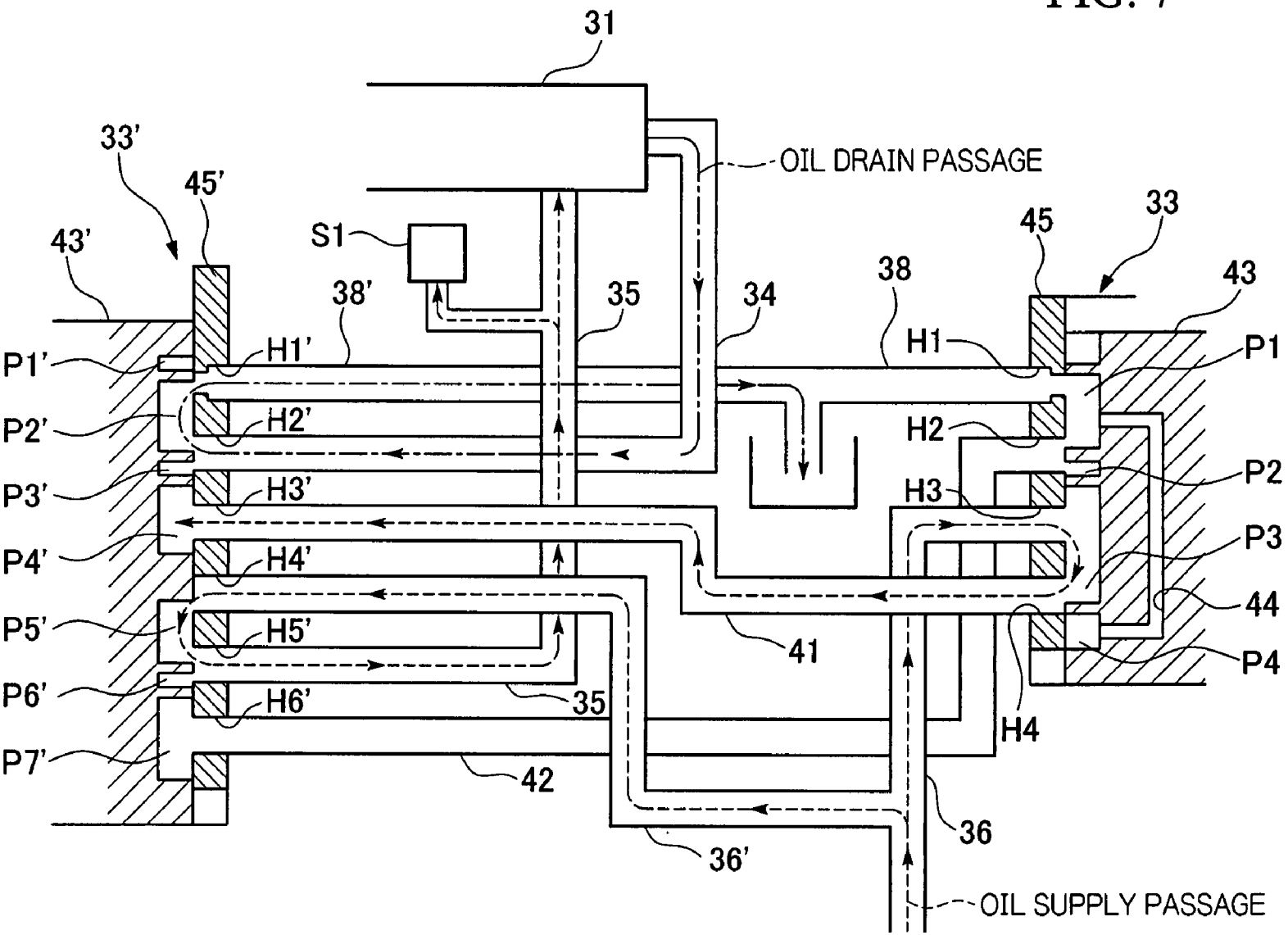
FIG. 7 is a diagram showing the flow of the operation oil in a state in which a spool valve 33 is switched into the all-cylinder deactivation mode, but the operation mode is in the all-cylinder activation mode due to operation of another spool valve 33'.

In contrast, when the spool 43 of the spool valve 33 is fixed in the position shown in FIG. 6 due to defectiveness, the spool valve 33' is operated as shown in FIG. 7.

FIG. 7 is a diagram showing the flow of the operation oil in the all-cylinder activation mode which is enforced by the spool valve 33' even though the spool valve 33 is switched into the all-cylinder deactivation mode. As shown in FIG. 7, the spool 43' of the spool valve 33' is moved downward when compared with the state shown in FIG. 6. As shown in FIG. 7, the spool valve 33' is controlled so that the drain branching passage 38' and the cylinder deactivation passage 34 are connected to each other via the port P2', and drain branching passage 38' and the cylinder activation passage 35 are connected to each other via the port P5'. The cylinder deactivation passage 34 and the cylinder deactivation connection passage 41 are disconnected from each other by the port P4'. The cylinder activation connection passage 42 and the cylinder activation passage 35 are disconnected from each other by the port P7'.

Accordingly, as shown in FIG. 7, the operation oil supplied from the oil pump 32 (see FIG. 4) flows into the connection port H4' of the spool valve 33' via the branching passage 36', and then flows into the cylinder activation passage 35 via the port P5' and the connection port H5', and thus the operation oil is supplied into the oil passage 59*a* in the rocker shaft 31. On the other hand, the operation oil that has been held in the oil passage 59*b* in the rocker shaft 31 flows into the connection port H2' in the spool valve 33' via the cylinder deactivation passage 34, and then flows into the drain branching passage 38' via the port P2' and the connection port H1'. The flow of the operation oil from the cylinder deactivation passage 34 into the cylinder deactivation connection passage 41 is blocked by the port P4', and the flow of the operation oil from the cylinder activation passage 35 into the drain passage 38 via the cylinder activation connection passage 42 is blocked by the port P7'.

As explained above, even when the spool 43 of the spool valve 33 is fixed in the position shown in FIG. 6 due to defectiveness, the engine E can be reliably placed in or returned to the all-cylinder activation mode by operating the spool 43' of the spool valve 33'.

According to the present embodiment, the connection or disconnection between the supply branching passage 36' and the cylinder activation passage 35, and the connection or disconnection between the drain branching passage 38' and the cylinder deactivation passage 34 can be executed by a single operation of the spool 43' of the spool valve 33'; therefore, a preferable efficiency in operation can be obtained.

Figure 8:
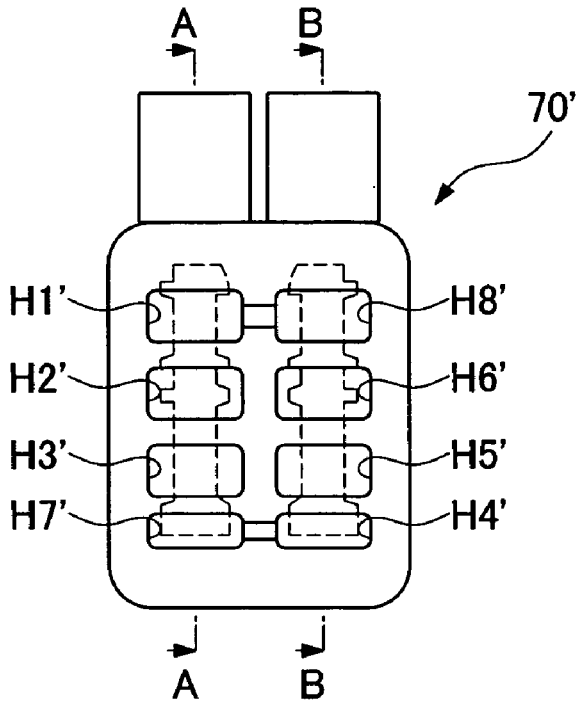
FIG. 8 is a plan view showing a spool valve 70' as a second embodiment of the present invention.
Figure 9A:
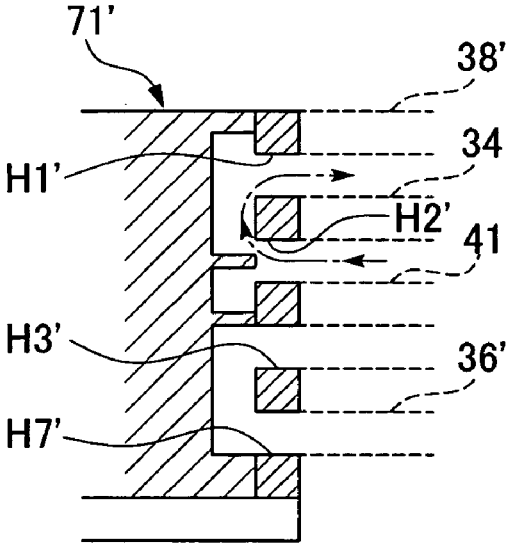
FIG. 9A is a cross-sectional view showing the spool valve 70' in FIG. 8 taken along the line A—A.
Figure 9B:
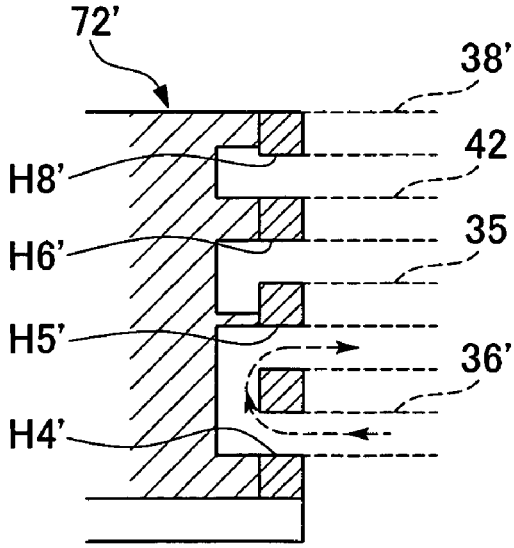
FIG. 9B is a cross-sectional view showing the spool valve 70' in FIG. 8 taken along the line B—B.

Next, a second embodiment of the present invention will be explained below with reference to FIG. 8. FIG. 8 is a plan view showing a spool valve 70' according to the second embodiment. FIG. 9A is a cross-sectional view showing the spool valve 70' in FIG. 8 taken along the line A—A, and FIG. 9B is a cross-sectional view showing the spool valve 70 in FIG. 8 taken along the line B—B. In these drawings, the same reference symbols are applied to the equivalent elements included in the first embodiment. As shown in FIGS. 8, 9A, and 9B, the spool valve 70' is provided with additional connection ports H7' and H8', and the spool valve 70' has two rows of connection ports arranged in the right-and-left direction in the drawings, each of which includes four connection ports. The spool valve 70' is provided with two spools 71' and 72' arranged in the right-and-left direction in the drawings. The spool 71' is made slidable to positions for making connection and disconnection between the drain branching passage 38' and the cylinder activation passage 35. The spool 72' is made slidable to positions for making connection and disconnection between the cylinder activation passage 35 and the supply branching passage 36'. In this embodiment, as in the first embodiment, even when the spool 43 of the spool valve 33 is fixed in the position shown in FIG. 6 due to defectiveness, the engine E can be reliably placed in or returned to the all-cylinder activation mode by operating the spools 71' and 72' of the spool valve 70' as shown in FIGS. 9A and 9B.

Industrial Applicability

As explained above, according to the cylinder operation control apparatus of the present invention, because the internal combustion engine can be reliably returned to the all-cylinder activation mode from a state in which all of the cylinders are deactivated, an all-cylinder deactivation operation, in which all of the cylinders are deactivated, may be executed; therefore, the engine friction can be greatly reduced, and thereby fuel economy can be improved.

According to another cylinder operation control apparatus of the present invention, the engine friction can be further reduced, and thereby fuel economy can be further improved.

According to another cylinder operation control apparatus of the present invention, the operation oil can be supplied to the cylinder activation passage so as to place the engine in the all-cylinder activation mode even when the engine is supposed to be placed in the cylinder deactivation mode in which the operation oil is supplied to the cylinder deactivation passage by the operation of the switching device. Therefore, the internal combustion engine can be reliably returned to the all-cylinder activation mode from a state in which all of the cylinders are deactivated, an all-cylinder deactivation operation, in which all of the cylinders are deactivated, may be executed. Accordingly, the engine friction can be greatly reduced, and thereby fuel economy can be improved.

According to another cylinder operation control apparatus of the present invention, the connection or disconnection between the supply branching passage and the cylinder activation passage, and the connection or disconnection between the drain branching passage and the cylinder deactivation passage can be executed by just a single operation; therefore, a preferable efficiency in operation can be obtained.

The invention claimed is:

1. A cylinder operation control apparatus comprising:

an internal combustion engine which is adapted to operate in an all-cylinder activation mode in which all-cylinders thereof are activated, and in a cylinder deactivation mode in which at least a cylinder thereof is deactivated;

a lift amount changing device which is associated with the internal combustion engine, and which enables switching between the all-cylinder activation mode and the cylinder deactivation mode by changing the amount of lifts of intake and exhaust valves associated with the cylinders;

a lift operating device which is associated with the lift amount changing device to operate the same;

a cylinder activation enforcing device which is operatively disposed between the lift amount changing device and the lift operating device so as to enforce the all-cylinder activation mode as necessary; and a control unit which is operatively connected to the lift amount changing device, the lift operating device, and the cylinder activation enforcing device, for controlling the operation mode of the internal combustion engine.

2. A cylinder operation control apparatus according to claim 1, wherein the lift amount changing device comprises a hydraulic variable valve timing mechanism.

3. A cylinder operation control apparatus according to claim 2, wherein the control unit is adapted to control the oil pressure for the hydraulic variable valve timing mechanism so as to suspend the operations of the intake and exhaust valves when the internal combustion engine is placed in the cylinder deactivation mode.

4. A cylinder operation control apparatus according to claim 2, wherein the control unit is adapted to operate the cylinder activation enforcing device so as to enforce normal operations of the intake and exhaust valves as necessary.

5. A cylinder operation control apparatus comprising:

an internal combustion engine which is adapted to operate in an all-cylinder activation mode in which all-cylinders thereof are activated, and in a cylinder deactivation mode in which at least a cylinder thereof is deactivated;

a lift amount changing device which is associated with the internal combustion engine, and which is adapted to change the amount of lifts of intake and exhaust valves associated with the cylinders using an operation oil supplied from a hydraulic power source;

a cylinder activation passage connected to the lift amount changing device for placing the internal combustion engine in the all-cylinder activation mode;

a cylinder deactivation passage connected to the lift amount changing device for placing the internal combustion engine in the cylinder deactivation mode;

an oil supply passage which is connected to the cylinder activation passage and the cylinder deactivation passage for supplying the operation oil to the lift amount changing device, and which is provided with an oil supply branching passage branching therefrom;

a drain passage which is connected to the cylinder activation passage and the cylinder deactivation passage for allowing the operation oil to return to the hydraulic power source, and which is provided with a drain branching passage branching therefrom;

a switching device which is connected to the cylinder activation passage, the cylinder deactivation passage, the oil supply passage, and the drain passage, for optionally supplying the operation oil from the hydraulic power source to the cylinder activation passage or to the cylinder deactivation passage; and a cylinder activation enforcing device which is connected to the cylinder activation passage, the cylinder deactivation passage, the oil supply branching passage, and the drain branching passage, for enforcing the all-cylinder activation mode.

6. A cylinder operation control apparatus according to claim 5, wherein the cylinder activation enforcing device comprises: a cylinder activation port for optionally connecting the oil supply branching passage to the cylinder activation passage or disconnecting the oil supply branching passage from the cylinder activation passage; and a cylinder deactivation port for optionally connecting the drain branching passage to the cylinder deactivation passage or disconnecting the drain branching passage from the cylinder deactivation passage.

7. A cylinder operation control apparatus according to claim 6, wherein the cylinder activation enforcing device comprises a spool valve having a spool therein, the spool valve being adapted to perform the connecting and disconnecting operations between the oil supply branching passage and the cylinder activation passage, and connecting and disconnecting operations between the drain branching passage and the cylinder deactivation passage, by sliding the spool to respective predetermined positions.

* * * * *